US005447046A

United States Patent [19]

Duffus

[11] Patent Number: 5,447,046

[45] Date of Patent: Sep. 5, 1995

[54] SECURITY BAR

[75] Inventor: Alexander M. Duffus, Glasgow, United Kingdom

[73] Assignee: SPS (Holdings) Limited, Glasglow, United Kingdom

[21] Appl. No.: 109,546

[22] Filed: Aug. 20, 1993

[30] Foreign Application Priority Data

Aug. 24, 1992 [GB] United Kingdom ..... 9217990

[51] Int. Cl.[6] ..... E05B 65/06

[52] U.S. Cl. ..... 70/101; 70/DIG. 64; 292/259 R

[58] Field of Search ..... 70/DIG. 64, 93, 94, 70/101, DIG. 66; 292/259 R, 338, 339, DIG. 44

[56] References Cited

U.S. PATENT DOCUMENTS

| | | | |
|---|---|---|---|
| 1,334,399 | 3/1920 | Porter . | |
| 3,636,659 | 1/1972 | Bylicki | 292/DIG. 17 X |
| 3,665,736 | 5/1972 | Wilson | 292/259 R X |
| 3,986,741 | 10/1976 | Giovannini | 292/268 |
| 4,078,836 | 3/1978 | Wilson | 292/259 R |
| 4,462,625 | 7/1984 | Barnhill | 292/259 R |
| 4,548,436 | 10/1985 | Cole, Jr. | 292/292 |
| 4,796,445 | 1/1989 | Norden, Jr. | 292/259 R X |
| 5,154,461 | 10/1992 | Prescott et al. | 292/DIG. 17 X |
| 5,257,581 | 11/1993 | Welling | 292/259 R X |

FOREIGN PATENT DOCUMENTS

| | | |
|---|---|---|
| 263426 | 12/1926 | United Kingdom . |
| 2218460 | 11/1989 | United Kingdom . |

*Primary Examiner*—Lloyd A. Gall
*Attorney, Agent, or Firm*—Keck, Mahin & Cate

[57] ABSTRACT

A security bar 14 for securing a door 2 hinged at one side of a door 2, the security bar 14 being hinged to the door surround 4 at the same side as the door 2 is hinged thereto and extending across the door surround 4 so as to be lockable with a locking device 18. The bar 14 is of freely adjustable length, and has its lockable end fixed relative to the door 2. Thus, the door 2 and the bar 14 pivot together about their respective displaced hinges by virtue of the varying length of the bar 14. The locking device is in the form of a key operated lock, the key of which is long enough to pass through the thickness of the door and into the lock.

6 Claims, 3 Drawing Sheets

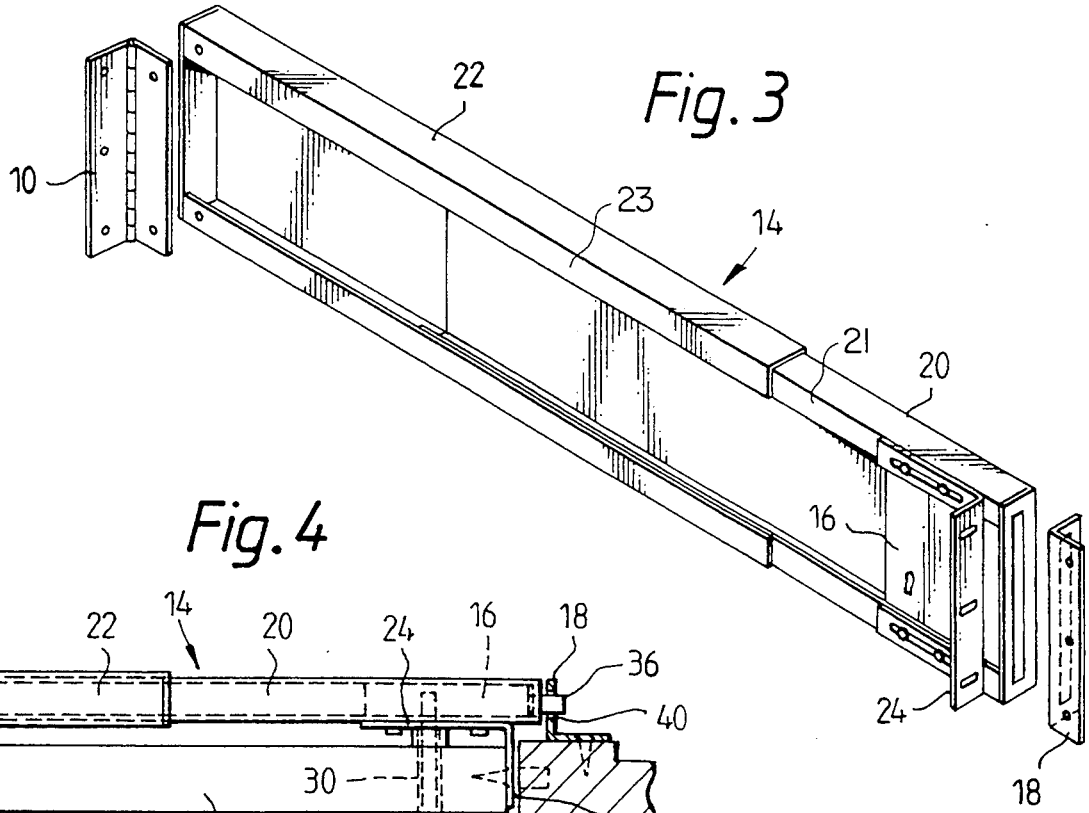
Fig. 3
Fig. 4
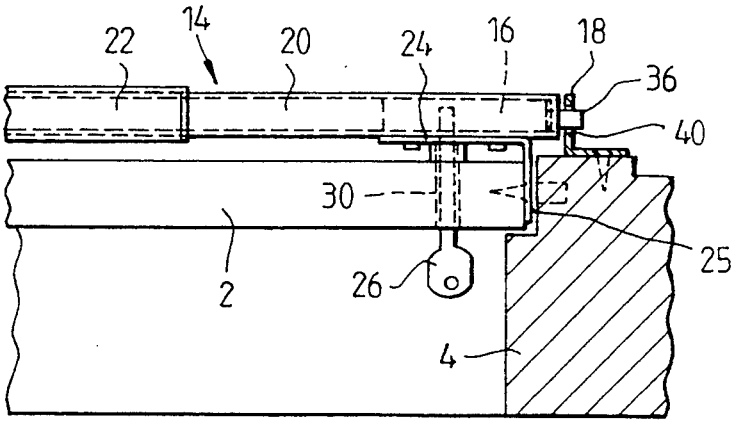
Fig. 8
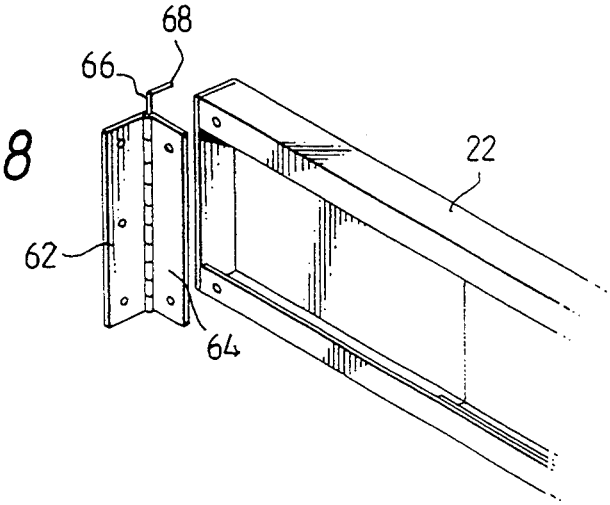

SECURITY BAR

FIELD OF THE INVENTION

The present invention relates to a security bar and more particularly to a security bar which may be fitted to an existing door to provide additional security.

Previously, it has been known to attach bars and panels across the outside of doors to hinder unauthorised entry. However, these involve considerable time and effort in their removal or installation and are, therefore, not suitable for regular or intermittent use.

It is an object of the present invention to provide a device for securing existing doors which may easily be opened by those authorised.

DESCRIPTION OF THE PRIOR ART

U.S. Pat. No. 3,986,741 discloses a security device in the form of a security bar for extending across the width of a door surround to secure a door hinged at one side to the door surround, said bar comprising a first elongate member, a second elongate member telescopically mounted on said first elongate member so as to allow longitudinal relative movement therebetween, a hinge mounted at one end of said first elongate member opposite said second elongate member for pivotally attaching the bar to the door surround at the same side as the door is hinged thereto, a bolt mounted at the end of the second elongate member remote from said hinge, a cooperating bolt keeper attachable to the other side of the door surround and lockingly engageable by the bolt and means for fixedly attaching said second elongate member to said door whereby said bar extends on one face thereof and whereby, in use, said hinge is attached to a door surround such that the bar pivots about an axis parallel and adjacent to the pivotal axis of the corresponding door, said bolt keeper is attached to the door surround so as to be lockable with said bolt and the door and the bar pivot together about their respective hinge axes.

With such a structure the bar may be mounted across the inside of a door such that, in its unbolted state, the member will merely swing open and closed with the door, but, in its bolted state, will provide a barrier beyond which the door may not be opened. However, the device is only usable by a person located inside the door.

SUMMARY OF THE INVENTION

The present invention provides a structure in which the bolt is replaced by a key operated locking means and a key for operating said locking means between locked and unlocked positions, said key being of adequate length to pass through a hole in the door to engage the lock from the other face of the door whereby the key is capable of operating both from said one face or the other face of the door with the bar attached thereto.

This enables a person to leave and securely fasten the door therebehind.

The first and second elongate members are telescopically attached to one another and said means for fixedly attaching said second elongate member may comprise a bracket on the end of the second elongate member which, in use, may be attached to the edge of the door such that, when the door is in the closed position, a portion of the bracket lies between the door edge and the door surround.

BRIEF DESCRIPTION OF THE DRAWINGS

The invention will be more clearly understood from the following description given by way of example only with reference to the accompanying drawings in which:

FIG. 3 illustrates the security bar of FIG. 1 from behind;

FIG. 4 illustrates the locked portion of the security bar of FIG. 1;

FIG. 8 illustrates a preferred hinge of the security bar.

DESCRIPTION OF THE PREFERRED EMBODIMENT

Figure 1:
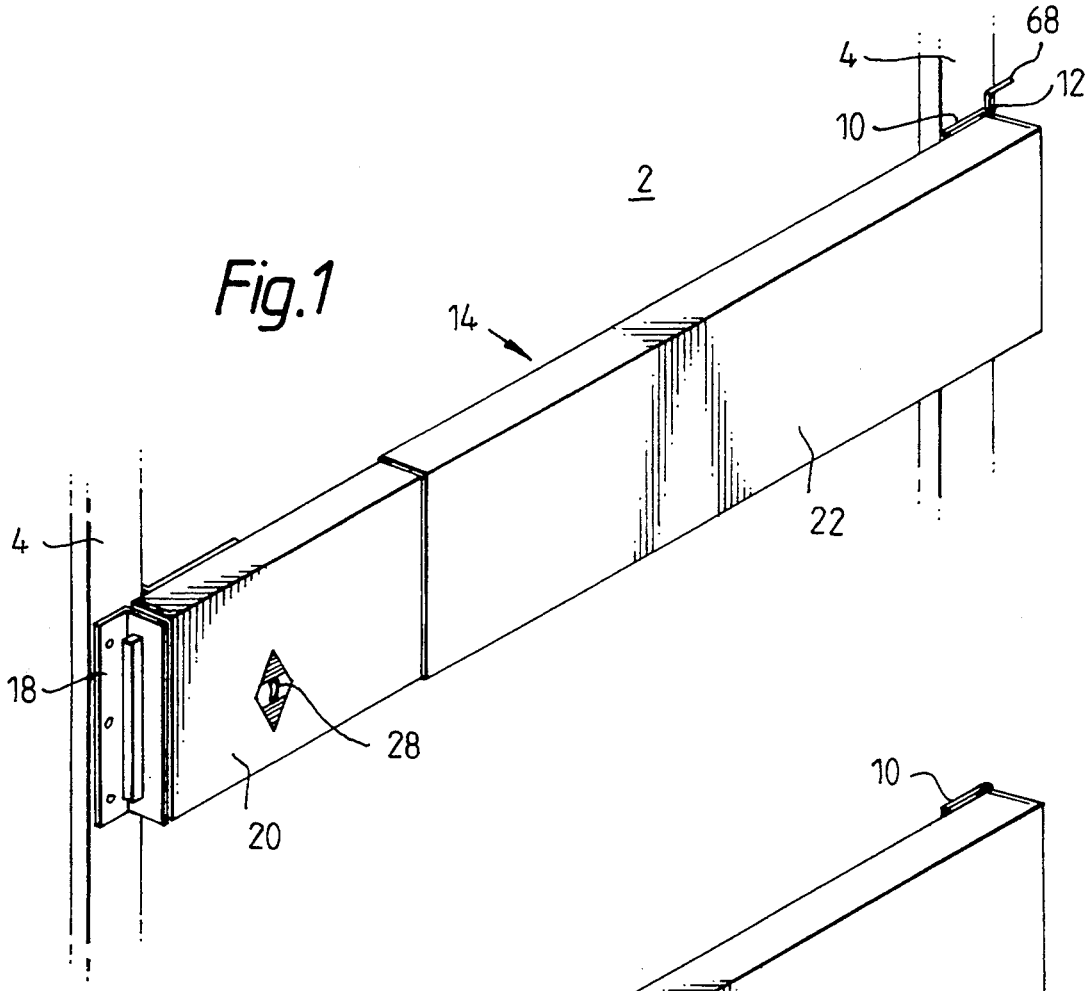
FIG. 1 illustrates a security member in a closed position.
Figure 2:
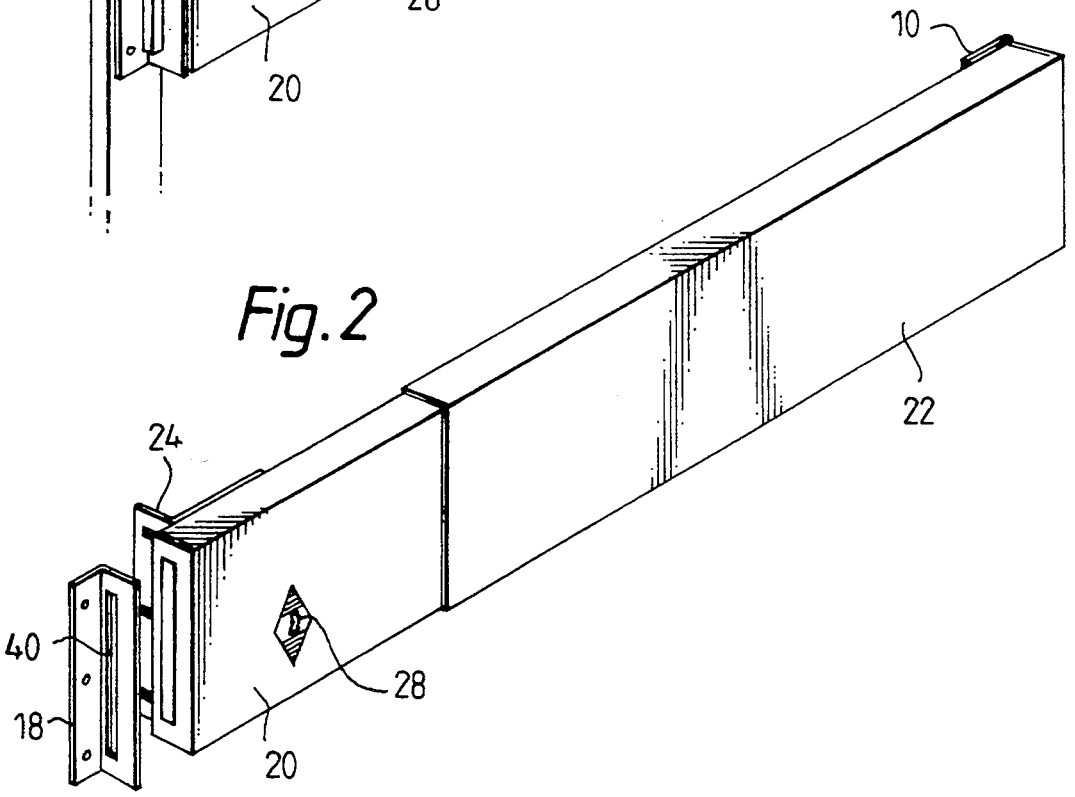
FIG. 2 illustrates the security bar of FIG. 1 separated from its catch plate.
Figure 5:
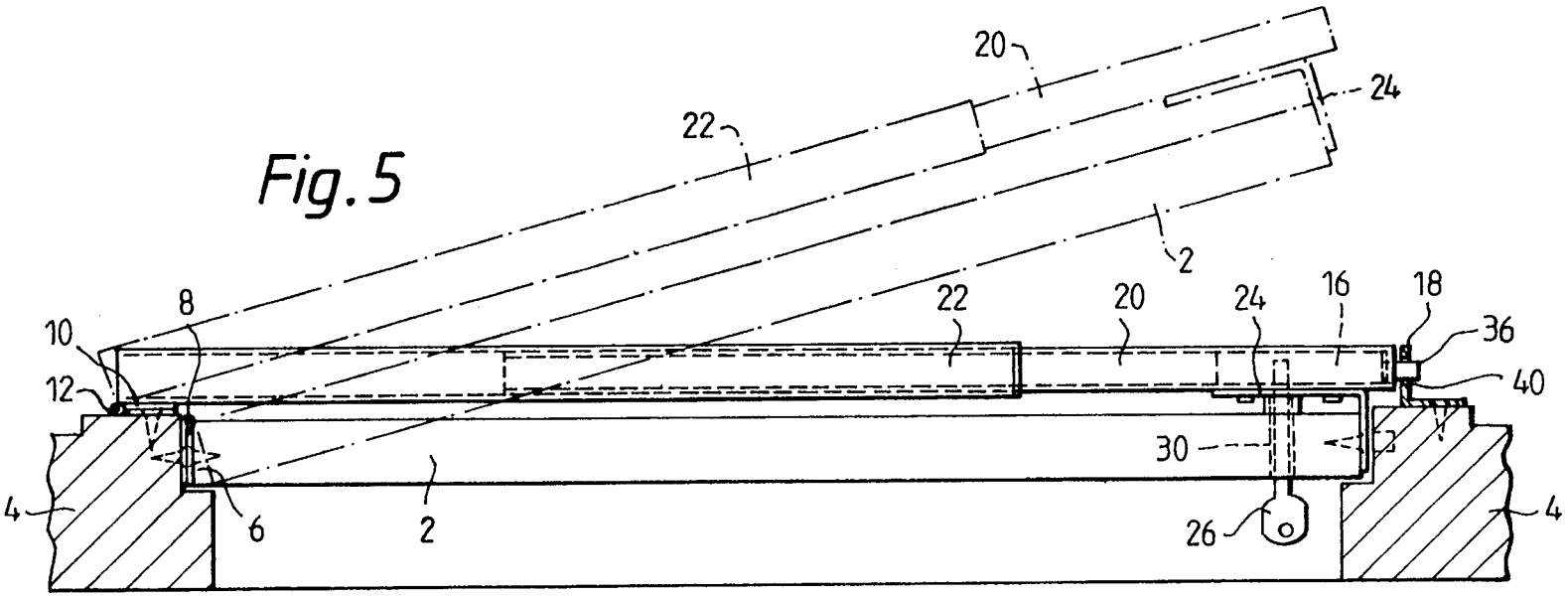
FIG. 5 illustrates the movement of the security bar of FIG. 1.

With reference to FIGS. 1 and 5, it will be seen that there is illustrated a conventional door 2 mounted by means of a hinge 6 to one of the door jambs 4 of a door frame or surround in a wall. Alternatively, the hinge could be secured directly to the wall or any other surrounding. The hinge has a first pivotal axis 8 and the door 2 may be secured in the closed position with the other door jamb 4 by means of a lock, the plunger of which is shown in FIGS. 4 to 7. Also, mounted on the first door jamb 4 by means of a hinge 10 having a second hinge axis 12 parallel to and spaced from the first axis 8, is a security bar of the invention indicated by the general reference numeral 14. At the second end of the bar 14, remote from the hinge 10, is a first locking means in the form of a conventional mortice lock 16 within the bar 14 which cooperates with a second locking means 18 in the form of a catch plate secured to the second door jamb. As illustrated in FIGS. 2 and 3, the bar 14 is formed of two telescopic channel section members 20,22 which may freely slide relative to one another and a bracket 24 is provided to secure the end of the bar 14 to the door 2, the channel section members 20,22 including inturned flanges 21,23, respectively.

The second elongate member 20 may be attached directly to the door 2 by means of screws and such like. However, as illustrated, bracket 24 is attached to the back of the member 20 and comprises a plate 25 which may be screwed to the edge of the door (possibly in a cut recess) so that it fits between the door 2 and the surround 4. This bracket 24 is advantageous in that the force between the bar 14 and door 2 is transmitted transversely across the screws attaching the bracket 24 to the door 2. The bracket 24 may be screwed/attached to the second elongate member 20 by means of legs, as illustrated, along the edges of the member or, alternatively, by a plate provided with a key hole.

It will therefore be appreciated that when the door is opened and closed, the bar 14, comprised of the telescopic members 20,22, will pivot about its axis 12, parallel to the axis 8 of the door hinge, the bracket 24 securing the end of the bar 14 to the door 2 and the sliding telescopic nature of the bar 14 allowing it always to move with the door.

In order that the bar 14 may pivot freely without strain on the attachments, it is advantageous that the bar 14 has some play in it to allow lateral movement perpendicular to the plane of the door 2. More specifically the outer depth of the flanges 21 of the second elongate member 20 should be slightly smaller than the inner depth of the flanges 23 of the first elongate member 22, preferably by about 1.5 mm. Alternatively, the bracket 24 may be hinged so as to allow the bar 14 to pivot relative to the door 2 when it is opened.

When the door is in the closed position illustrated in FIGS. 1 and 5, the lock 16 on the second end of the bar 14 will be positioned adjacent to the catch plate 18 on the door jamb 4 and, if one wishes to lock the bar from the interior, the bar 14 can then be locked in addition to the locking of the door by means of a key 26 passing through the key hole 28. However, as one wishes to lock the bar 14 from the exterior, the key 26 must be long enough to be passed through the thickness of the door, via an aperture 30, and engage into the lock.

Figure 7:
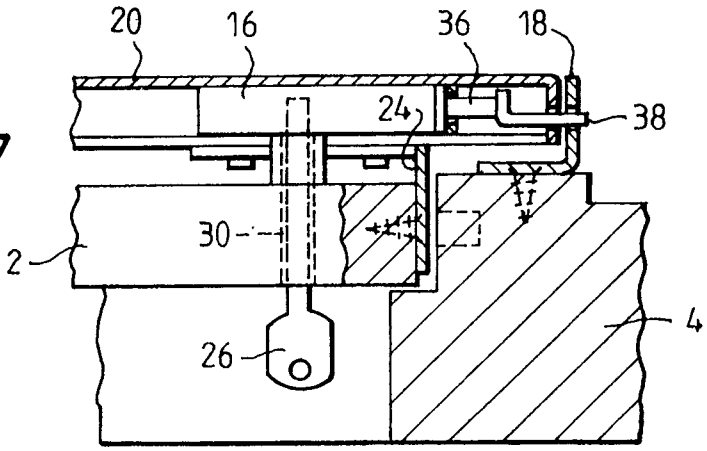
FIG. 7 illustrates the end portion of a second embodiment of the security bar.
Figure 6:
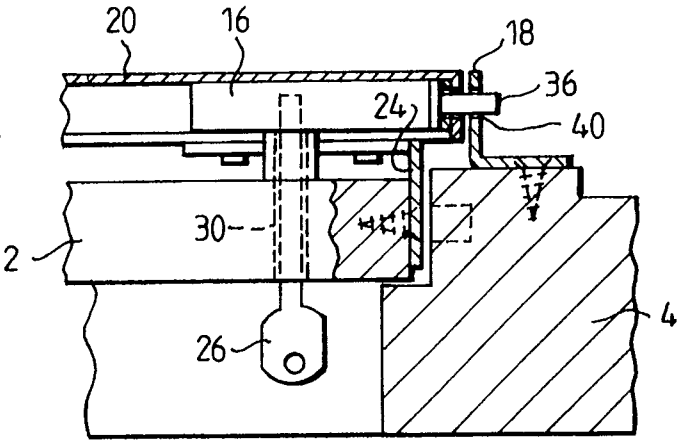
FIG. 6 illustrates the end portion of one embodiment of the security bar.

The lock 16 is illustrated in FIGS. 6 and 7 and comprises a standard mortice lock operated by a key 26 to move plunger 36 in a locking or unlocking direction. The plunger 36 may itself provide the locking action as illustrated in FIG. 6, but, as illustrated in FIG. 7, an extension 38 may be attached to the plunger 36. In operation, the extension 38 is moved in or out of the aperture 40 of the catch plate 18.

Alternatively, it is also possible to mount a lock on the door jamb 4 which is engageable with a catch plate on the bar 14. This catch plate may be formed as an integral part of the member 20 itself, i.e., merely an aperture in the end face.

FIGS. 1 and 8 also illustrate an alternative type of hinge which may be used with the present invention. Just as in the other figures, the hinge comprises two plates indicated in FIG. 8 by 62 and 64, each for attachment to one of the door jamb and the security bar and each having at least one substantially cylindrical section. With the cylindrical sections aligned with one another and concentric with the pivotal axis 12, a pin 66 is located through them such that the hinge may operate about the pivotal axis. The hinge of FIG. 8 differs from that of the other figures in that the pin is provided with a means (a hook 68 as illustrated) by which the pin may be withdrawn from one end. Thus, in the event of an emergency, the security bar may be removed from its installation by withdrawing pin 66, thereby allowing the hinge 10 to separate into its two parts, and pulling the bar away from the door such that the plunger 36 or extension 38 is disengaged from the locking means 18.

The particular manner in which the length of the security bar is adjusted is not essential to the invention and, indeed, need not be telescopic. The bar should be attached to the door such that the extension 38 is not freed from the catch plate 18 by virtue of adjustment of the length of the attached bar, but the length of the bar should freely vary so as to take account of the displaced pivotal axis 8 and 12 and allow the bar 14 to move freely with the door 2.

Additionally, the security bar will fit a range of widths of door so that a standard security bar may be manufactured and used for doors of different widths.

I claim:

1. A key and security bar combination for extending across the width of a door surround to secure a door hinged about a pivotal axis at one side to the door surround, said bar comprising:

a first elongate member;

a second elongate member telescopically mounted on said first elongate member so as to allow longitudinal relative movement therebetween;

a hinge mounted at one end of said first elongate member opposite said second elongate member for pivotally attaching the bar to the door surround at the same side as the door is hinged thereto;

a first locking means operable from both sides of the door mounted at the end of the second elongate member remote from said hinge;

a cooperating second locking means attachable to the other side of the door surround and lockingly engageable with the first locking means; and means for fixedly attaching said second elongate member to said door whereby said bar extends parallel to one face thereof;

said key for operating said first locking means between locked and unlocked positions, said key being of adequate length to pass through a hole in the door to engage said first locking means from the other face of the door whereby the key is capable of operating both from said one face or the other face of the door with the bar attached thereto;

said hinge being attachable to the door surround such that the bar pivots about an axis of said hinge which is non-colinear with but parallel to the pivotal axis of the corresponding door, effective to cause the door and the bar to pivot together about their respective hinge axes as the door opens and closes and with said members undergoing said longitudinal relative movement.

2. A key and security bar combination for extending across the width of a door surround to secure a door hinged about a pivotal axis at one side to the door surround, said bar comprising:

a first elongate member;

a second elongate member telescopically mounted on said first elongate member so as to allow longitudinal relative movement therebetween;

a hinge mounted at one end of said first elongate member opposite said second elongate member for pivotally attaching the bar to the door surround at the same side as the door is hinged thereto;

a first locking means operable from both sides of the door mounted at the end of the second elongate member remote from said hinge;

a cooperating second locking means attachable to the other side of the door surround and lockingly engageable with the first locking means; and a bracket on said end of the second elongate member which, in use, may be fixedly attached to an edge of the door such that, when the door is in the closed position, a portion of the bracket lies between the door edge and the door surround and whereby said bar extends parallel to one face of said door;

said key for operating said first locking means between locked and unlocked positions, said key being of adequate length to pass through a hole in the door to engage the first locking means from the other face of the door whereby the key is capable of operating both from said one face or the other face of the door with the bar attached thereto;

said hinge being attachable to the door surround such that the bar pivots about an axis of said hinge which is non-colinear with but parallel to the pivotal axis of the corresponding door, effective to cause the door and the bar to pivot together about their respective hinge axes as the door opens and closes and with said members undergoing said longitudinal relative movement.

3. A key and security bar combination as claimed in claim 2, wherein said telescopically attached members comprise two channel sectioned members, one dimensioned to slide within the other.

4. A key and security bar combination as claimed in claim 2, wherein said hinge comprises a first part attached to said first elongate member and a second part attachable to said door surround, the first part being pivotally and detachably attached to the second part.

5. A key and security bar combination as claimed in claim 4, wherein said hinge further comprises a pin having an axis about which the first and second parts relatively pivot, the pin being capable of being withdrawn by hand from said hinge along its axis so as to allow the two parts to be detached.

6. A key and security bar combination as claimed in claim 2, wherein the second locking means further comprises means for attaching it to an inner face of said other side of the door surround parallel to said one face of the door.

* * * * *